United States Patent [19]

Fearnside et al.

[11] 4,375,009

[45] Feb. 22, 1983

[54] SHIELDED ELECTRICAL CABLE

[75] Inventors: James T. Fearnside, Lexington; Thomas P. Stephens, Boxford, both of Mass.

[73] Assignee: Hewlett-Packard Company, Palo Alto, Calif.

[21] Appl. No.: 214,933

[22] Filed: Dec. 10, 1980

[51] Int. Cl.[3] ..... H01B 7/34

[52] U.S. Cl. ..... 174/36; 138/127; 174/35 R; 174/107; 174/117 M; 174/124 R; 338/308; 219/545; 174/109; 174/69

[58] Field of Search ..... 174/35 R, 36, 69, 68 R, 174/107, 109, 110 R, 117 M, 124 R; 219/211, 212, 528, 529, 545, 535; 338/208, 209, 210; 66/154 A, 170; 138/123, 125, 127; 87/6, 15

[56] References Cited

U.S. PATENT DOCUMENTS

| | | | |
|---|---|---|---|
| 975,359 | 11/1910 | Hefter | 338/208 |
| 2,355,018 | 8/1944 | Stover | 174/124 R |
| 2,670,620 | 3/1954 | Goldstraub | 338/208 X |
| 2,863,032 | 12/1958 | Morris | 174/109 |
| 3,215,768 | 11/1965 | Murphy | 174/36 |
| 3,240,867 | 3/1966 | Maddox | 174/109 X |
| 3,253,618 | 5/1966 | Cook | 174/36 X |
| 3,274,329 | 9/1966 | Timmons | 174/69 |
| 3,467,761 | 9/1969 | Plummer | 174/36 |
| 4,069,410 | 1/1978 | Keep, Jr. | 219/535 |

FOREIGN PATENT DOCUMENTS

| | | | |
|---|---|---|---|
| 554330 | 1/1957 | Italy | 174/36 |
| 416550 | 9/1934 | United Kingdom | 174/124 R |

*Primary Examiner*—Volodymyr Y. Mayewsky
*Attorney, Agent, or Firm*—Donald N. Timbie

[57] ABSTRACT

An electrical cable having a shielding comprised of knit or knit-graded wire having metal coatings.

3 Claims, 3 Drawing Figures

SHIELDED ELECTRICAL CABLE

BACKGROUND OF THE INVENTION

This invention relates to improvements in shielding for electrical cables and is particularly advantageous when used with cables that are to be considerably flexed by hand in use, such as those connected between a medical instrument and transducers or other devices that are to be held against or attached to the body of a patient. Shielding is essential so as to prevent radio frequency energy and other electrical fields from interfering with the extremely small signals carried by the various leads of the cable. In order to be the most effective, the shield should have an extremely low resistance between any point on it and either end.

Shielding of the prior art has included loosely braided wire strands, but this did not provide as much torsional flexibility as desired. Cables have also been shielded by wrapping flattened knit wire tubes or a foil tape around the cable. The former is bulky, and both, aside from being too stiff, are subject to the formation of gaps when twisted or bent.

BRIEF DESCRIPTION OF THE INVENTION

In accordance with this invention, a highly flexible and effective shield having a low resistance is provided by knit or knit-braided tubes of wire knitted or knit-braided on the outside of the cable. Although the tubes could be mounted by inserting the cable through them, it has been found far easier and less expensive to form the tube from wire on the cable as it is being manufactured. The knitting or knit-braiding can be done by textile machines known in the art that are adapted for wire.

DETAILED DESCRIPTION OF THE INVENTION

Figure 1:
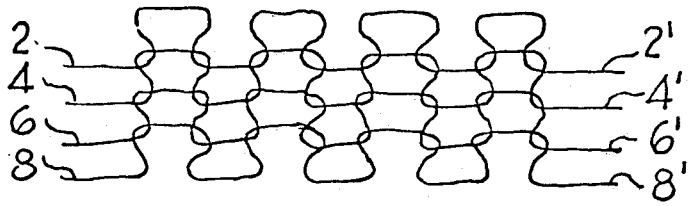
FIG. 1 illustrates a knitted sheath construction.

A knit article is one in which one or two strands are interleaved in a series of interconnected loops, such as illustrated in FIG. 1.

A braided article is one in which three or more strands are woven, interlaced or entwined together. When an article is formed by three or more strands that are held together by interconnected loops, as illustrated in FIG. 2, it is herein referred to as a "knit braid".

A shield constructed in accordance with this invention may be made from wire by existing machines in a tubular configuration. The cable may then be inserted into the shield, but lower cost and a more homogenous and close fitting can be achieved if the shield is either knit or knit-braided as the cable is being manufactured.

Although various types of wire may be used, it has been effective to use wire having a steel core that is copper clad and silver or tin plated. The steel does not work-harden during flexing so that it has a long life. In addition, the fact that steel is magnetic improves its shielding characteristics. The copper cladding increases the electrical conductivity so as to decrease the resistance of the shield, and the silver or tin plating keeps the wire from corroding, provides lubricity that makes it easier for the machines to handle, and maintains a surface to which it is easy to solder the connections at the ends of the shield.

Figure 2:
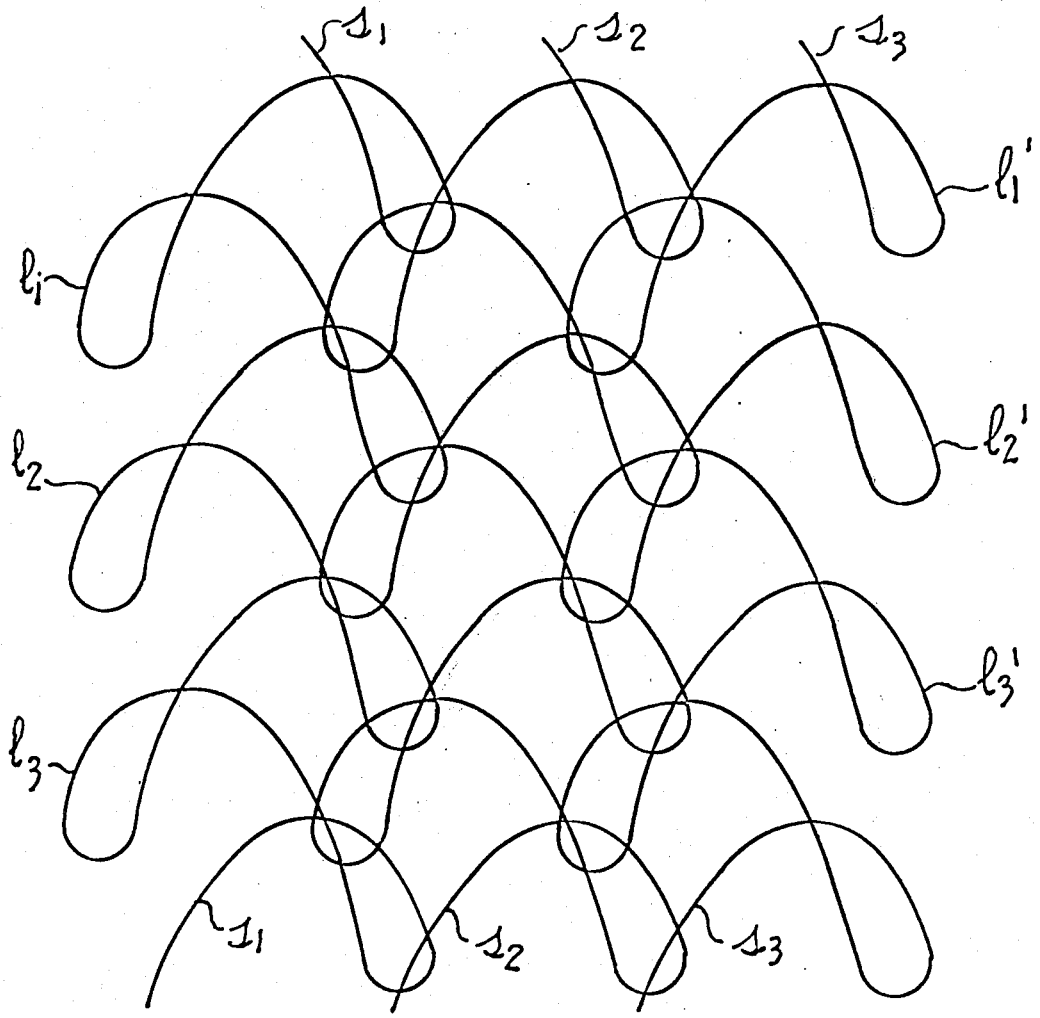
FIG. 2 illustrates a knit-braided sheath construction.

The knit shield may be constructed in tubular form using knitting machines modified for handling wire such as single and double wire end circular or flat bed knitting machines, and it may be constructed in the knit-braid form of FIG. 2 by a combination knit-braider that utilizes many strands of wire.

A knit shield such as illustrated in FIG. 1 is adequate mechanically and does allow the cable to twist torsionally, but because it has only one or two wires running the full length, achievement of a low resistance requires that the knit loops remain in electrical contact while the cable is flexed. As the cable is flexed in use, the knit loops move around and cease to be in electrical contact so as to increase the resistance of the shield and lower its effectiveness.

Whereas both knit and knit-braided shields provide great flexibility as desired, the latter is preferred because it has many wires running the full length of the shield so as to maintain a low resistance from one end of the shield to the other regardless of whether there is good electrical contact between loops. Such a shield may therefore be flexed many times without impairing its effectiveness.

Figure 3:
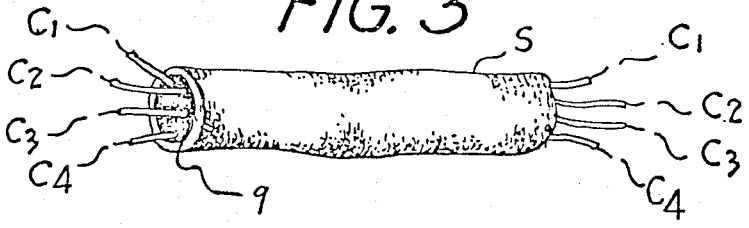
FIG. 3 illustrates a cable with a shielding sheath or tube.

In the interest of simplifying the drawing, neither FIG. 1 nor FIG. 2 show a shield having a tubular form such as that mounted on the outside of the cable as shown in FIG. 3, but it will be readily appreciated that the ends 2, 4, 6 and 8 at the left side of FIG. 1 would be joined to the ends 2', 4', 6' and 8' at the right side when the knit shield is tubular in shape; and that the loops $\mathbf{1}_1$, $\mathbf{1}_2$ and $\mathbf{1}_3$ at the left side of FIG. 2 would be interlocked with the loops $\mathbf{1}_1'$, $\mathbf{1}_2'$ and $\mathbf{1}_3'$ at the right side when the knit-braid shield is tubular in shape.

Note that the knit shield of FIG. 1 has only one strand starting at the end 2 and ending at the end 8' so that the length of the strand is many times the length of a shield just as the length of yarn used to form the ankle part of a knit sock is many times the length of that part. On the other hand, the knit-braid shield of FIG. 2 may have a considerable number of strands that go from one end of the shield to the other, but for simplicity in drawing, only three strands $s_1$, $s_2$ and $s_3$ are shown. Since the strands $s_1$, $s_2$ and $s_3$ need only be two or three times the length of the shield, the resistance of the shield from one end to the other cannot exceed that of one strand; and if any of the loops are in electrical contact, the resistance will be less than that of one strand because at least portions of some strands will be electrically connected in parallel.

FIG. 3 illustrates an electrical cable having four conductors $c_1$, $c_2$, $c_3$ and $c_4$, each of which is insulated, surrounded by a sheath 9 that in an actual case would tightly enclose the insulated conductors $c_1$, $c_2$, $c_3$ and $c_4$. On the outside of the sheath 9 is a shield S that may be constructed in the knit or knit-braided form in accordance with this invention. As it would be far too complicated to show either form of shield precisely, the shield S is only an artist's presentation of the general appearance.

What is claimed is:

1. An electrical cable, comprising an electrically insulating sheath, a plurality of insulated electrical conductors mounted within said sheath, and shielding made from wire that is knit with said wire in the form of an integral sleeve encompassing said sheath, said wire having a steel core, a first coating of metal of greater conductivity than said steel core and a second coating of a metal having greater lubricity than the first coating.

2. An electrical cable, comprising an electrically insulating a sheath, a plurality of insulated electrical conductors mounted within said sheath, and shielding made from wire that is knit-braided with said wire in the form of an integral sleeve encompassing said sheath, said wire having a steel core, a first coating of metal of greater conductivity than said steel core and a second coating of a metal having greater lubricity than the first coating.

3. An electrical cable as set forth in claim 2 wherein said first coating is copper and said second coating is silver or tin.

* * * * *